US005259114A

United States Patent [19]

Shorter

[11] Patent Number: 5,259,114

[45] Date of Patent: Nov. 9, 1993

[54] REVERSIBLE COMB-SHEARS

[76] Inventor: Troy Shorter, 1320 Harrison, Davenport, Iowa 52803

[21] Appl. No.: 983,209

[22] Filed: Nov. 30, 1992

[51] Int. Cl.[5] ..... B26B 13/24

[52] U.S. Cl. ..... 30/131; 30/195; 30/252; 132/148

[58] Field of Search ..... 30/195, 131, 145, 252, 30/232, 271, 345; 132/148, 126

[56] References Cited

U.S. PATENT DOCUMENTS

| | | | |
|---|---|---|---|
| 2,008,631 | 7/1935 | Udkovich | 30/195 |
| 2,677,179 | 5/1954 | Servilla | 30/195 X |
| 4,642,895 | 2/1987 | Gauvry | 30/271 X |

FOREIGN PATENT DOCUMENTS

| | | | |
|---|---|---|---|
| 866316 | 2/1953 | Fed. Rep. of Germany | 30/195 |
| 3506386 | 8/1986 | Fed. Rep. of Germany | 30/195 |

*Primary Examiner*—Douglas D. Watts
*Assistant Examiner*—Rinaldi Rada
*Attorney, Agent, or Firm*—Henderson & Sturm

[57] ABSTRACT

An apparatus for cutting hair, which includes a comb assembly attached to the blades of a pair of scissors. The handles of the apparatus are identical so that the comb-shears may be reversed to conveniently enable the use of combs with different sized teeth on the two shear blades. The invention also provides for rubber grommets to be placed within the middle finger/thumb loops and for the placement of a rubber pad between the handle pivot stops for increased user comfort.

1 Claim, 1 Drawing Sheet

Fig. 1
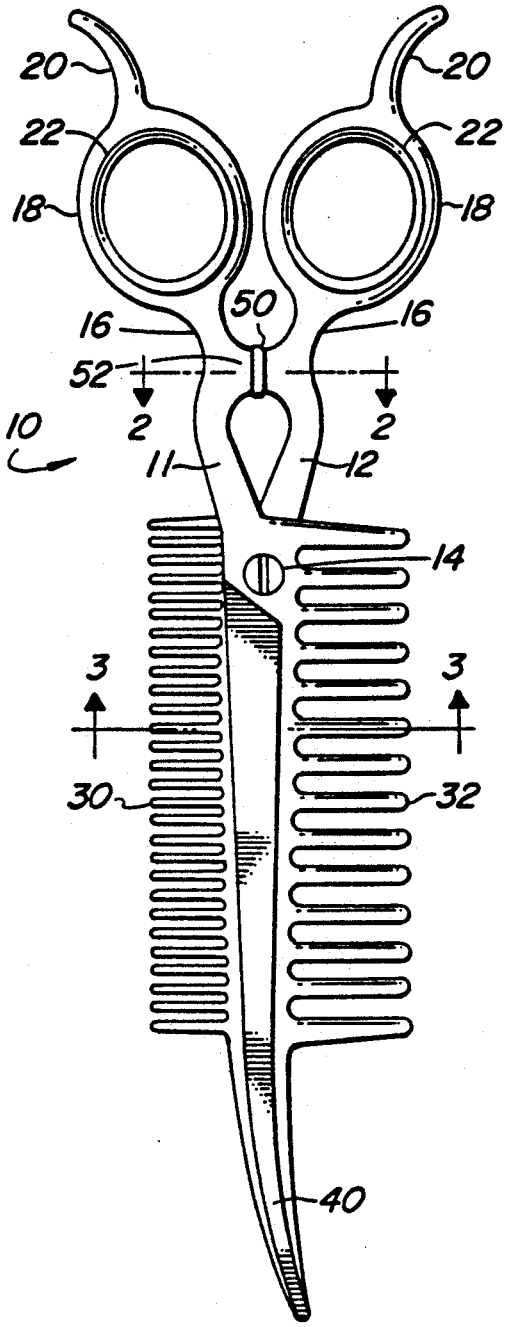
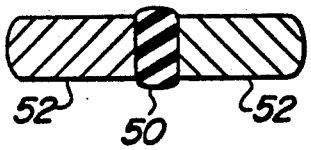
Fig. 2
Fig. 3
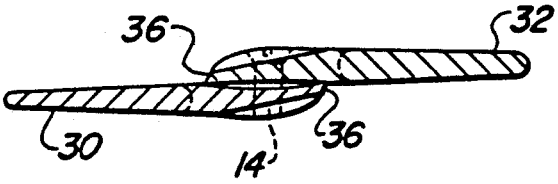

REVERSIBLE COMB-SHEARS

TECHNICAL FIELD

The present invention is directed to shears for cutting hair, and more particularly to an improved combination of shears and comb in one device so as to facilitate the cutting of hair.

BACKGROUND ART

While numerous developments have been made in the design of equipment for the cutting of hair, most of these advances have been in the area of electrical apparatus such as clippers. The present invention involves an advanced design for a combination of a pair of scissors and a comb.

DISCLOSURE OF THE INVENTION

Many barbers and hair stylists continue to use an ordinary pair of scissors in conjunction with a comb in the process of cutting hair, despite the development of electric clippers and other automated devices. A typical sequence a barber will use in cutting hair is to use his right hand to comb out a section of hair which is to be cut. He will then grasp this section of hair between the fingers of his left hand, transfer the comb from right hand to left hand, and then cut the hair with the scissors in his right hand. After cutting the section of hair, he must then retransfer the comb back to his right hand to start the process anew. The present invention will do away with the requirement to transfer the comb back and forth between hands each time a cut is to be made, since the scissors and comb are contained in the same apparatus. Thus the barber may comb out a section of hair to be cut with the comb-shears in his right hand, grasp the section of hair with the left hand, and then cut the hair with the comb-shears still held in his right hand. This process may be repeated without the need to transfer the comb-shears between hands. The comb-shears are reversible for the use of different comb sizes for different thicknesses of hair, and also have a curved tip on the cutting blades for more efficient edging and lining of the hair.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is a plan view of the present invention;

FIG. 2 is a cross-sectional view taken along line 2—2 of FIG. 1; and FIG. 3 is a cross-sectional view taken along line 3—3 of FIG. 1.

BEST MODE FOR CARRYING OUT THE INVENTION

Referring now to the drawings, wherein like reference numerals designate identical or corresponding parts throughout the several views, FIG. 1 presents a preferred embodiment of the present invention 10. A first member 11 is pivotally connected to a second member 12 by means of a screw or rivet 14 as is well known in the art. Each member comprises a cutter/comb section and a handle section which are generally separated by the position of the pivot 14. Each handle section has an indentation 16 conforming to the placement of the index finger, a loop 18 conforming to the placement of the middle finger or thumb, and an extended portion 20 conforming to the placement of the ring finger. Within each of the middle finger/thumb loops may be inserted a rubber grommet 22 for added user comfort.

The preferred embodiment of the invention has a pair of comb assemblies 30 and 32 as an integral part of the cutter/comb-handle members, although it is apparent that only one comb assembly is necessary. In the preferred embodiment, the comb assemblies have a different number of teeth with a corresponding difference in the size of spacing between the teeth to accommodate differences in hair thickness. The cutting blades 36 of each of the members may be most clearly seen in FIG. 3. FIG. 1 makes apparent the curvature 40 near the ends of the cutting blades to more easily facilitate edging and lining of the hair. FIG. 1 and FIG. 2 also show a rubber bumper pad 50 attached to either or both of the handle section pivot stops 52 to reduce the impact when the handles are closed.

It may therefore be understood that the present invention enables a barber or hairstylist to use the often preferred comb and scissor method of cutting hair without the need to continually transfer the comb and scissors between hands.

Those skilled in the art will recognize that many modifications and variations of the present invention are possible in light of the above teachings. It is therefore to be understood that, within the scope of the appended claims, the invention may be practiced otherwise than as specifically described.

I claim:

1. An apparatus for cutting hair, comprising:

a first elongate piece;

a second elongate piece, pivotally attached to said first elongate piece;

cutting sections formed on said first and second elongate pieces;

handle sections formed on said first and second elongate pieces;

sharpened edges being formed on the cutting sections of said first and second elongate pieces;

serrated edges being formed on the cutting sections of said first and second elongate pieces;

means, formed on said handle sections, for facilitating gripping of said elongate pieces;

said serrated edge of said first elongate piece comprises a plurality of teeth extending laterally therefrom; and said serrated edge of said second elongate piece comprises a plurality of teeth extending laterally therefrom which are more closely spaced than said teeth on said first piece.

* * * * *